US009942666B2

(12) United States Patent
Yoshino et al.

(10) Patent No.: US 9,942,666 B2
(45) Date of Patent: Apr. 10, 2018

(54) CONDENSER MICROPHONE UNIT, CONDENSER MICROPHONE, AND METHOD OF MANUFACTURING CONDENSER MICROPHONE

(71) Applicant: KABUSHIKI KAISHA AUDIO-TECHNICA, Tokyo (JP)

(72) Inventors: Satoshi Yoshino, Tokyo (JP); Hiroaki Furuya, Tokyo (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 0 days.

(21) Appl. No.: 15/283,608

(22) Filed: Oct. 3, 2016

(65) Prior Publication Data

US 2017/0142526 A1 May 18, 2017

(30) Foreign Application Priority Data

Nov. 12, 2015 (JP) ..... 2015-222470

(51) Int. Cl.

| | |
|---|---|
| ***H04R 3/00*** | (2006.01) |
| ***H04R 19/04*** | (2006.01) |
| ***H04R 1/04*** | (2006.01) |
| ***H04R 31/00*** | (2006.01) |

(52) U.S. Cl.

CPC ..... *H04R 19/04* (2013.01); *H04R 1/04* (2013.01); *H04R 31/006* (2013.01)

(58) Field of Classification Search

CPC ..... H04R 19/04; H04R 1/04; H04R 31/006
USPC ..... 381/91, 111, 113, 122, 355, 361, 363; 29/2–899.1

See application file for complete search history.

(56) References Cited

U.S. PATENT DOCUMENTS

| | | | | |
|---|---|---|---|---|
| 4,910,795 | A * | 3/1990 | McCowen | H04R 1/04 381/355 |
| 5,377,519 | A * | 1/1995 | Hayashi | B21D 28/10 72/326 |
| 8,948,433 | B2 * | 2/2015 | Akino | H04R 1/025 381/356 |
| 2005/0163336 | A1 * | 7/2005 | Hiramoto | H04R 19/04 381/369 |
| 2006/0110000 | A1 | 5/2006 | Akino | |
| 2008/0219482 | A1 * | 9/2008 | Sato | H04R 19/04 381/174 |
| 2008/0277586 | A1 * | 11/2008 | Cardinale | G01M 3/002 250/339.13 |

(Continued)

FOREIGN PATENT DOCUMENTS

| | | |
|---|---|---|
| EP | 1494503 A1 | 5/2005 |
| JP | 2607288 Y2 | 5/2001 |

(Continued)

*Primary Examiner* — William A Jerez Lora
(74) *Attorney, Agent, or Firm* — Whitham, Curtis & Cook

(57) ABSTRACT

A condenser microphone is provided that can ensure the fixation of an electroacoustic transducer inside a unit case and the grounding of the electroacoustic transducer, regardless of variations in manufacture of the unit case and a circuit board. A condenser microphone unit includes an electroacoustic transducer and a unit case accommodating the electroacoustic transducer. The unit case includes at least one protrusion that is disposed on the inner circumferential surface of the unit case. The electroacoustic transducer is fixed inside the unit case with the protrusion.

9 Claims, 9 Drawing Sheets

(56) References Cited

U.S. PATENT DOCUMENTS

2009/0136073 A1* 5/2009 Chang ..... H04R 21/02
381/361

FOREIGN PATENT DOCUMENTS

| | | | |
|---|---|---|---|
| JP | 2004343368 | A | 12/2004 |
| JP | 4514565 | B2 | 7/2010 |
| JP | 2011223138 | A | 11/2011 |

* cited by examiner

CONDENSER MICROPHONE UNIT, CONDENSER MICROPHONE, AND METHOD OF MANUFACTURING CONDENSER MICROPHONE

TECHNICAL FIELD

The present invention relates to a condenser microphone unit, a condenser microphone, and a method of manufacturing a condenser microphone.

BACKGROUND ART

A condenser microphone unit (hereinafter referred to as "unit") includes, for example, an electroacoustic transducer, a circuit board having an impedance converter, and a unit case having a shape of a hollow cylinder with a bottom end. The electroacoustic transducer and the circuit board are accommodated in the unit case. The electroacoustic transducer includes a diaphragm and a fixed electrode that face each other with a spacer disposed therebetween. The electroacoustic transducer detects a variation in capacitance of a capacitor constituted by the diaphragm and the fixed electrode, and converts acoustic waves received by the diaphragm into audio signals.

The electroacoustic transducer is fixed inside the unit case with the circuit board to maintain a constant distance between the diaphragm and the fixed electrode. The grounding of the electroacoustic transducer is achieved with the unit case and ground patterns disposed on the circuit board.

The state of fixation of the electroacoustic transducer inside the unit case and the state of grounding of the electroacoustic transducer affect the characteristics of the unit. If the fixation of the electroacoustic transducer inside the unit case is insufficient, the distance between the diaphragm and the fixed electrode increases and the frequency response characteristics of the unit deteriorate, for example. On the other hand, if the grounding of the electroacoustic transducer is insufficient, the unit unintentionally detects external signals, such as radio frequency signals. Thus, the audio signals output from the unit contain noise.

With respect to techniques for achieving fixation of the electroacoustic transducer inside the unit case and grounding of the electroacoustic transducer, techniques have been proposed to urge a circuit board having a shape of a disk, the ground patterns of which are disposed on the circumferential surface, into the unit case through the open end of the unit case (for example, refer to Japanese Utility Model Registration No. 2607288).

In the unit disclosed in Japanese Utility Model Registration No. 2607288, an electroacoustic transducer is fixed inside the unit case with the circuit board urged in the unit case. The grounding of the electroacoustic transducer is achieved by the contact between the ground patterns on the circumferential surface of the circuit board and the unit case. Thus, the fixation of the electroacoustic transducer inside the unit case and the grounding of the electroacoustic transducer depend on the dimensional accuracy of the circuit board. That is, for example, if the diameter of the circuit board is smaller than the diameter of the opening of the unit case, the fixation of the electroacoustic transducer inside the unit case and the grounding of the electroacoustic transducer are not ensured.

The circuit board is composed of insulating synthetic resin, for example, and fabricated by press working. Thus, the circuit board is affected by contraction due to temperature and variations in manufacture, for example. In other words, the dimensional accuracy of the circuit board is low. That is, in the unit disclosed in Japanese Utility Model Registration No. 2607288, it is difficult to achieve with certainty the fixation of the electroacoustic transducer inside the unit case and the grounding of the electroacoustic transducer.

With respect to techniques for achieving fixation of the electroacoustic transducer inside the unit case and grounding of the electroacoustic transducer without being affected by variations in manufacture of the circuit board, techniques have been proposed to swage the open end of a unit case inward to press an electroacoustic transducer into the unit case with a circuit board (for example, refer to Japanese Patent No. 4514565).

In the unit disclosed in Japanese Patent No. 4514565, the swaged edge of the open end of the unit case presses ground patterns disposed on the periphery of the circuit board. As a result, the fixation of the electroacoustic transducer inside the unit case and the grounding of the electroacoustic transducer are achieved. The ground patterns are disposed on the circuit board at regular intervals along the circumferential direction. Thus, the pressing force of the edge of the open end of the unit case on the ground patterns of the circuit board increases. As a result, the electrical conduction between the unit case and the circuit board is ensured and stabilized. That is, the grounding of the electroacoustic transducer is sufficiently achieved.

SUMMARY OF INVENTION

Technical Problem

The unit case is formed into a shape of a hollow cylinder with a bottom end, for example, by drawing of a metal plate and then blanking out the open end. The edge of the open end of the unit case has a cut surface provided by the blanking. Thus, the edge of the open end of the unit case has irregularities of several tens of to several hundred micrometers. When such a unit case is swaged, the ground patterns of the circuit board is pressed by the edge of the open end of the unit case having the irregular surface. Thus, the ground patterns of the circuit board and the edge of the open end of the unit case are not in contact with each other at some sites and are in tight contact with each other at other sites. That is, the fixation of the electroacoustic transducer inside the unit case and the grounding of the electroacoustic transducer are unstable.

An object of the present invention is to solve the problems described above and to ensure the fixation of the electroacoustic transducer inside the unit case and the grounding of the electroacoustic transducer regardless of variations in manufacture of the unit case and the circuit board.

Solution to Problem

The condenser microphone unit according to the present invention includes an electroacoustic transducer and a unit case accommodating the electroacoustic transducer. The unit case includes at least one protrusion disposed on an inner circumferential surface of the unit case. The electroacoustic transducer is fixed inside the unit case with the protrusion.

The condenser microphone unit according to the present invention can ensure the fixation of the electroacoustic transducer inside the unit case and the grounding of the electroacoustic transducer.

DESCRIPTION OF EMBODIMENTS

Embodiments of the condenser microphone unit, the condenser microphone, and the method of manufacturing a condenser microphone will now be described with reference to the attached drawings.

Condenser Microphone Unit

Configuration of Condenser Microphone Unit

Figure 1:
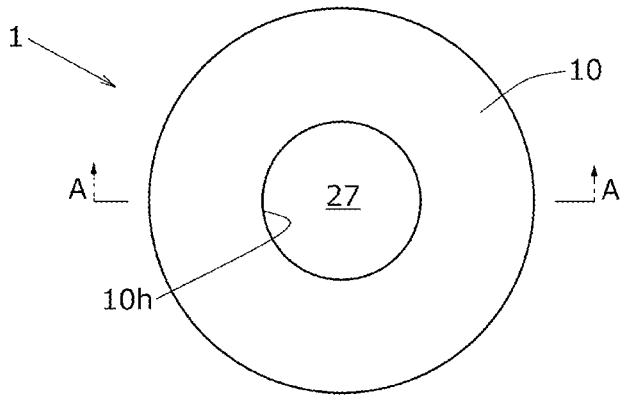
FIG. 1 is a plan view illustrating an embodiment of a condenser microphone unit according to the present invention.

FIG. 1 is a plan view of an embodiment of a condenser microphone unit according to the present invention.

Figure 2:
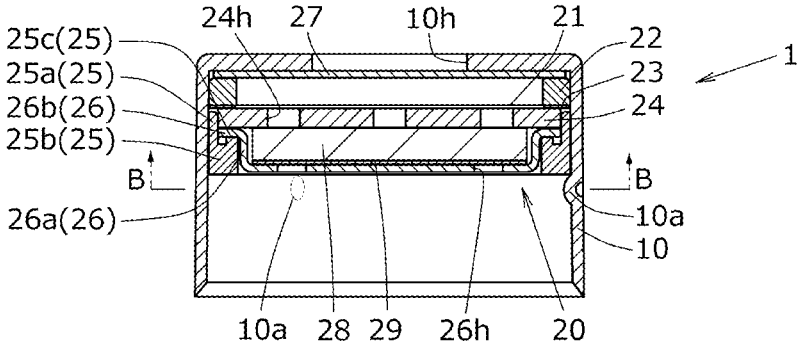
FIG. 2 is a cross-sectional view of the condenser microphone unit taken along the line A-A of FIG. 1.

FIG. 2 is a cross-sectional view of the condenser microphone unit taken along the line A-A of FIG. 1.

A condenser microphone unit (hereinafter referred to as "microphone unit") 1 converts acoustic waves into audio signals and outputs the audio signals. The microphone unit 1 includes a unit case 10 and an electroacoustic transducer 20 accommodated in the unit case 10.

The unit case 10 is composed of metal, such as aluminum. The unit case 10 is a press-molded product formed by a drawing process and having a shape of a hollow cylinder with a bottom end. The unit case 10 has an acoustic-wave entering hole 10*h* and multiple protrusions 10*a*. The acoustic-wave entering hole 10*h* introduces acoustic waves from a sound source into the unit case 10. The acoustic-wave entering hole 10*h* is disposed in the center of the bottom of the unit case 10. The acoustic-wave entering hole 10*h* extends across the thickness of the bottom of the unit case 10. The multiple protrusions 10*a* are disposed on the inner circumferential surface of the unit case 10 so as to protrude inward from the inner circumferential surface. The protrusions 10*a* will be described below.

In the description below, the direction to which the outer surface of the bottom of the unit case 10 is directed (the upper side of FIG. 2) is referred to as the "front," and the direction to which the open end of the unit case 10 is directed (the lower side of FIG. 2) is referred to as the "rear."

The electroacoustic transducer 20 includes a diaphragm 21, a diaphragm holder (diaphragm ring) 22, a spacer 23, a fixed electrode 24, an insulator 25, a support 26, a front mesh 27, an acoustic resistor 28, and a rear mesh 29. The electroacoustic transducer 20 is fixed inside the unit case 10.

The diaphragm 21 is configured to vibrate in response to acoustic waves entering the unit case 10. The diaphragm 21 is a circular thin film in plan view. A metal (preferably gold) film is deposited on one side of the diaphragm 21. The diaphragm holder 22 is composed of metal and has a shape of a ring. The diaphragm 21 is stretched on the rear surface of the diaphragm holder 22 with a predetermined tension (see FIG. 4).

The spacer 23 is composed of synthetic resin. The spacer 23 has a shape of a thin ring.

The fixed electrode 24 is composed of metal and has a shape of a disk. The fixed electrode 24 is disposed so as to face the diaphragm 21. The fixed electrode 24 constitutes a capacitor with the diaphragm 21, as described below. The capacitance of the capacitor varies with the vibration of the diaphragm 21 caused by the acoustic waves entering the unit case 10 through the acoustic-wave entering hole 10*h*. The fixed electrode 24 has an electret plate and multiple sound holes 24*h* that extend across the thickness (in the front-rear direction) of the fixed electrode 24. The electret plate is attached on the surface (front surface) facing the diaphragm 21 of the fixed electrode 24. The fixed electrode 24 and the electret plate form a so-called electret board.

The insulator 25 supports the fixed electrode 24 and the support 26 and electrically insulates the conduction path leading from the diaphragm 21, from the conduction path leading from the fixed electrode 24. The insulator 25 is composed of insulating material, such as synthetic resin. The insulator 25 has a shape of a substantially hollow cylinder open in the front-rear direction. The insulator 25 consists of a front portion 25*a*, a rear portion 25*b*, and a step portion 25*c*. In the insulator 25, the inner diameter of the front portion 25*a* (the portion of the insulator 25, which is in the upper side of FIG. 2) is larger than the inner diameter of the rear portion 25*b* (the portion of the insulator 25, which is in the lower side of FIG. 2). The step portion 25*c* is disposed on the inner circumferential surface of the insulator 25 between the front portion 25*a* and the rear portion 25*b*.

The support 26 supports the acoustic resistor 28, described below, and ensures the conduction path leading from the fixed electrode 24. The support 26 is composed of metal. The support 26 has an accommodating portion 26*a* having a shape of a hollow cylinder with a bottom end and flattened in the front-rear direction, and a flange portion 26*b* having a shape of a ring and protruding outward from the open end of the accommodating portion 26*a*. That is, the support 26 has a shape of a hat in cross-sectional view. The accommodating portion 26*a* has multiple sound holes 26*h*. The sound holes 26*h* are disposed in the bottom of the accommodating portion 26*a* at equal intervals along the circumferential direction of the bottom. The sound holes 26*h* extend across the thickness of the bottom of the accommodating portion 26*a*. The length of the accommodating portion 26*a* in the front-rear direction is shorter than the length of the rear portion 25*b* of the insulator 25 in the front-rear direction.

The front mesh 27 is a metal mesh. The acoustic resistor 28 is composed of sponge, for example. The rear mesh 29 is a metal mesh.

Method of Manufacturing Microphone Unit

The method of manufacturing a microphone unit will now be described.

Figure 3:
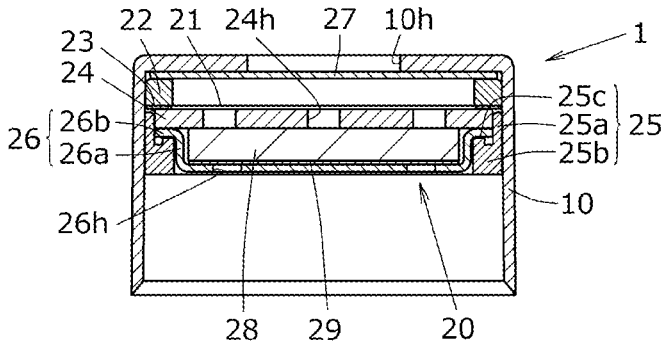
FIG. 3 is a cross-sectional view of the condenser microphone unit in FIG. 2 in an assembled state before formation of protrusions.

FIG. 3 is a cross-sectional view of the microphone unit 1 in FIG. 2 in an assembled state before formation of the protrusions 10*a*.

Figure 4:
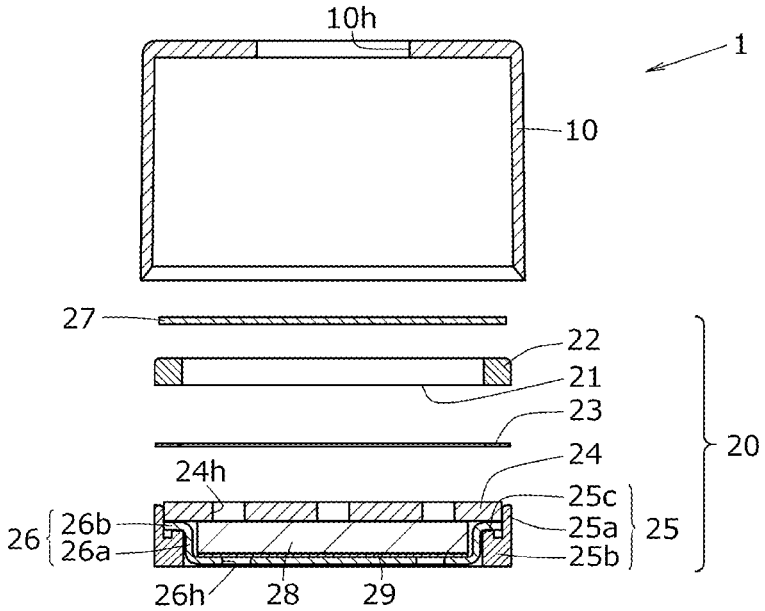
FIG. 4 is a cross-sectional exploded view of the condenser microphone unit in FIG. 3.

FIG. 4 is a cross-sectional exploded view of the microphone unit 1 in FIG. 3.

The electroacoustic transducer 20, that is, the diaphragm holder 22 holding the diaphragm 21, the spacer 23, the fixed electrode 24, the insulator 25, the support 26, the front mesh 27, the acoustic resistor 28, and the rear mesh 29, is accommodated in the unit case 10.

First, the front mesh 27 is disposed on the inner surface of the bottom of the unit case 10. The front mesh 27 covers the acoustic-wave entering hole 10*h* from the inside of the unit case 10.

Then, the diaphragm holder 22 is fitted into the unit case 10. The front surface of the diaphragm holder 22 comes into contact with the front mesh 27. That is, the front mesh 27 is held between the bottom of the unit case 10 and the diaphragm holder 22. The outer circumferential surface of the diaphragm holder 22 comes into contact with the inner circumferential surface of the unit case 10. As a result, the unit case 10 is electrically connected to the diaphragm 21 with the diaphragm holder 22.

Then, the spacer 23 is disposed into the unit case 10. The spacer 23 comes into contact with the periphery of the rear surface of the diaphragm 21.

The accommodating portion 26*a* of the support 26 is inserted into the rear portion 25*b* of the insulator 25. The flange portion 26*b* of the support 26 is supported by the step portion 25*c* of the insulator 25. The acoustic resistor 28 and the rear mesh 29 are accommodated in the accommodating portion 26*a*. The rear mesh 29 is disposed on the front surface of the bottom of the accommodating portion 26*a*. The rear mesh 29 covers the sound holes 26*h* of the accommodating portion 26*a* from the inside of the accommodating portion 26*a*. The acoustic resistor 28 is disposed between the fixed electrode 24 and the rear mesh 29.

The fixed electrode 24 is fitted into the front portion 25*a* of the insulator 25. That is, the insulator 25 supports the fixed electrode 24 from the rear of the fixed electrode 24. Then, the flange portion 26*b* comes into contact with the fixed electrode 24 and the step portion 25*c*. That is, the flange portion 26*b* is held between the fixed electrode 24 and the step portion 25*c*. As described above, the length of the accommodating portion 26*a* in the front-rear direction is shorter than the length of the rear portion 25*b* of the insulator 25 in the front-rear direction. Thus, in the front-rear direction of the unit case 10, the rear surface of the bottom of the accommodating portion 26*a* is disposed in front of the rear end surface of the rear portion 25*b* of the insulator 25. That is, the rear surface of the bottom of the accommodating portion 26*a* is disposed in front of the rear end surface of the insulator 25.

The fixed electrode 24, the insulator 25, the support 26, the acoustic resistor 28, and the rear mesh 29 are integrally fitted into the unit case 10. Alternatively, the fixed electrode 24, the insulator 25, the support 26, the acoustic resistor 28, and the rear mesh 29 may be individually accommodated in the unit case 10.

The fixed electrode 24 is disposed behind the diaphragm 21 parallel to the diaphragm 21. The spacer 23 is disposed between the diaphragm 21 and the fixed electrode 24. That is, a space having a thickness equivalent to that of the spacer 23 is defined between the diaphragm 21 and the fixed electrode 24.

Although the microphone unit 1 according to the present embodiment is a unidirectional microphone unit introducing acoustic waves from the sound source in the front-rear direction of the diaphragm 21, the microphone unit of the present invention may have any directivity other than unidirectivity. That is, the microphone unit may be an omnidirectional microphone unit having no sound hole on the accommodating portion of the support, for example. In this case, a space between the fixed electrode and the accommodating portion functions as an air chamber accommodating no acoustic resistor therein.

Figure 5:
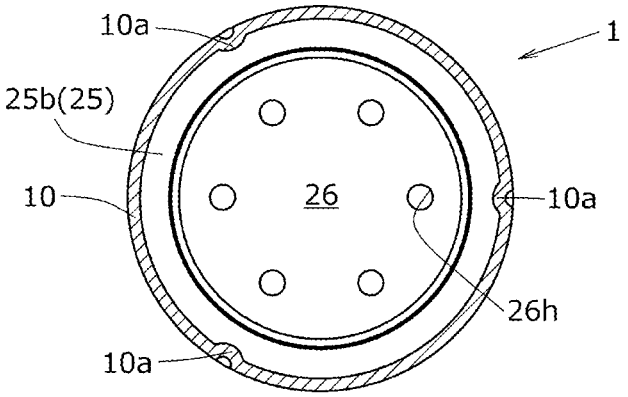
FIG. 5 is a cross-sectional view of the condenser microphone unit taken along the line B-B of FIG. 2.

FIG. 5 is a cross-sectional view of the microphone unit 1 taken along the line B-B of FIG. 2.

After the electroacoustic transducer 20 is accommodated in the unit case 10, the protrusions 10*a*, described above, are formed on the unit case 10. The protrusions 10*a* are formed by pressing the outer circumferential surface of the unit case 10 toward the inside of the unit case 10 with a puncher, for example. The electroacoustic transducer 20 may be pressed and accommodated in the unit case 10 with a dedicated jig, for example. As shown in FIG. 5, the protrusions 10*a* are formed at three sites at equal intervals along the circumferential direction of the unit case 10.

As shown in FIG. 2, the protrusions 10*a* come into contact with the rear end surface of the insulator 25. The insulator 25 is pressed forward by the protrusions 10*a*. Thus, the fixed electrode 24 is pressed forward by the protrusions 10*a* with the step portion 25*c* of the insulator 25 and the flange portion 26*b* of the support 26. That is, the distance between the diaphragm 21 and the fixed electrode 24 is maintained equivalent to the thickness of the spacer 23. In other words, the electroacoustic transducer 20 is fixed inside the unit case 10 with the protrusions 10*a*.

The number and the positions of the protrusions 10*a* should not be limited to the present embodiment. That is, the protrusions 10*a* may be formed at any even number of sites symmetrically about the diameter of the opening of the unit case 10, for example.

As described above, the method of manufacturing the microphone unit 1 includes accommodating the electroacoustic transducer 20 in the unit case 10, forming the protrusions 10*a* on the inner circumferential surface of the unit case 10, and fixing the electroacoustic transducer 20 with the protrusions 10*a*.

Condenser Microphone

The condenser microphone according to the present invention will now be described.

Configuration of Condenser Microphone

Figure 6:
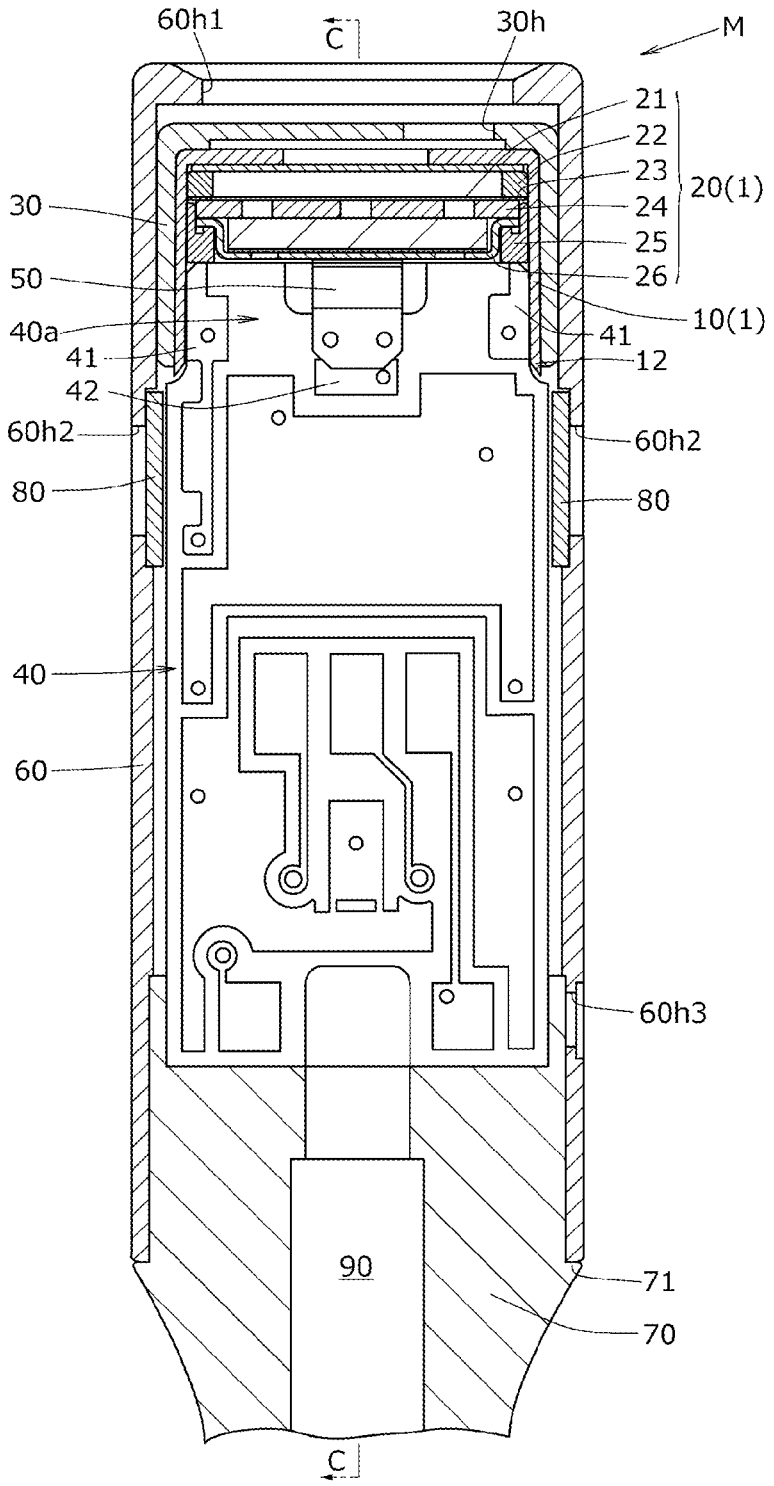
FIG. 6 is a cross-sectional right side view of a condenser microphone according to the present invention.

FIG. 6 is a cross-sectional right side view of the condenser microphone according to the present invention.

Figure 7:
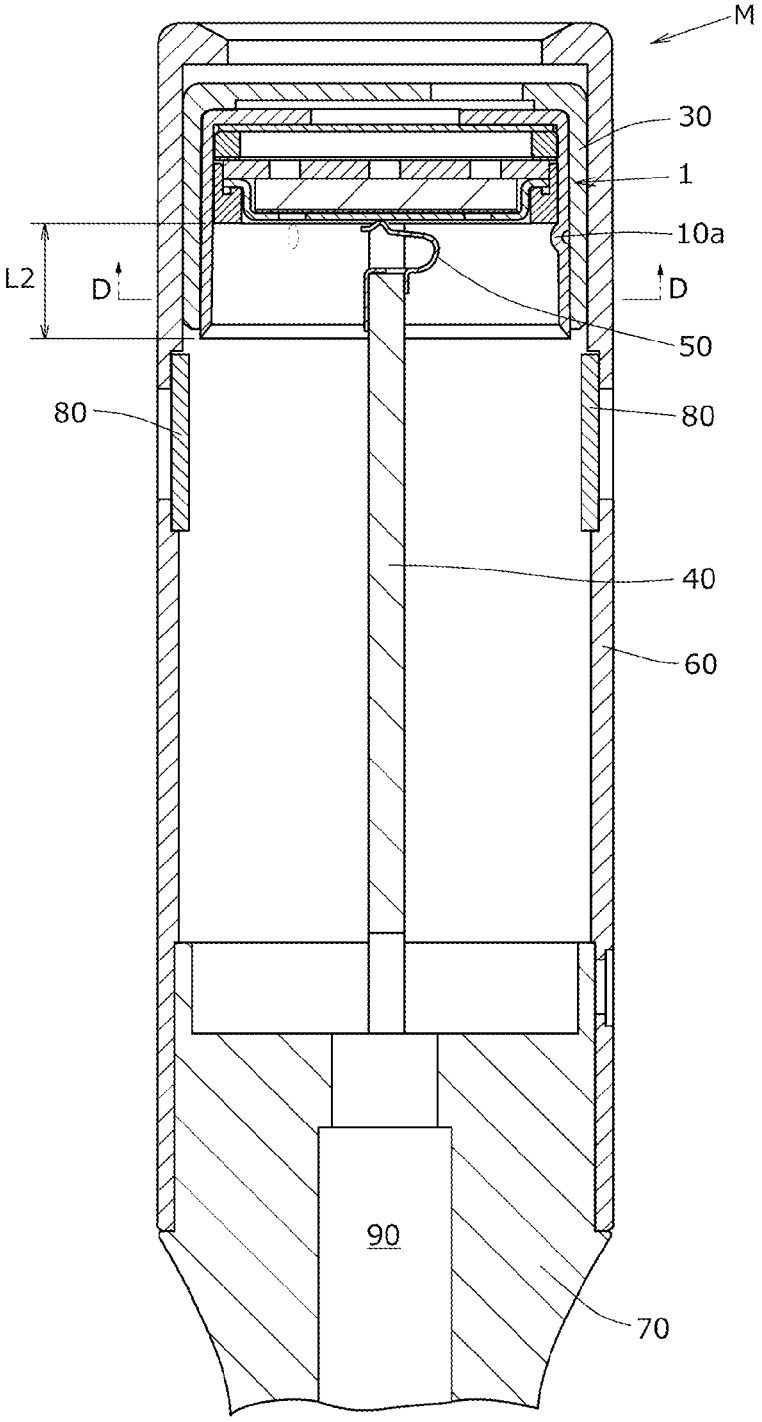
FIG. 7 is a cross-sectional view of the condenser microphone taken from the line C-C of FIG. 6.

FIG. 7 is a cross-sectional view of the condenser microphone taken along the line C-C of FIG. 6.

A condenser microphone (hereinafter referred to as "microphone") M collects acoustic waves from a sound source. The microphone M includes the microphone unit 1, a unit cover 30, an audio-signal output circuit board (hereinafter referred to as "circuit board") 40, a biasing member 50, a microphone case 60, a rear case 70, and a mesh 80.

The unit cover 30 electrically separates the unit case 10 from the microphone case 60. The unit cover 30 is composed of insulating synthetic resin, for example. The unit cover 30 has a shape of a hollow cylinder with a bottom end. The unit cover 30 has an acoustic-wave entering hole 30*h*. The acoustic-wave entering hole 30*h* is disposed in the bottom of the unit cover 30, located at the front end of the unit cover 30. The acoustic-wave entering hole 30*h* extends across the thickness (in the front-rear direction) of the bottom of the unit cover 30.

Figure 8:
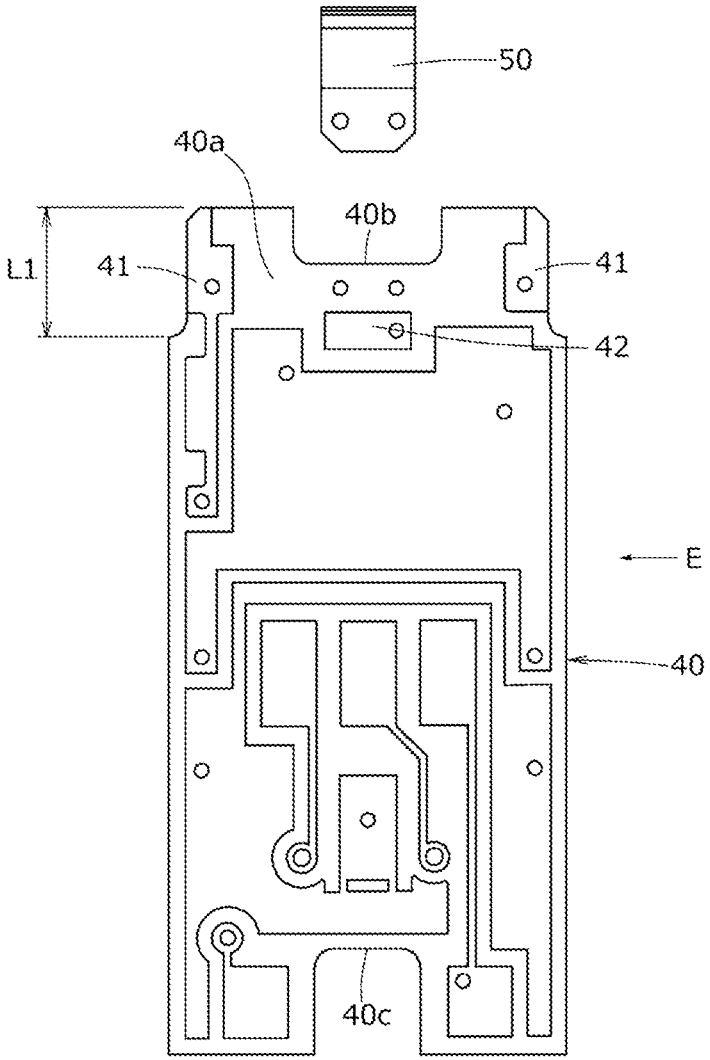
FIG. 8 is an exploded view of an audio-signal output circuit board and a biasing member included in the condenser microphone in FIG. 6.

FIG. 8 is an exploded view of the circuit board 40 and the biasing member 50 included in the microphone M.

Figure 9:
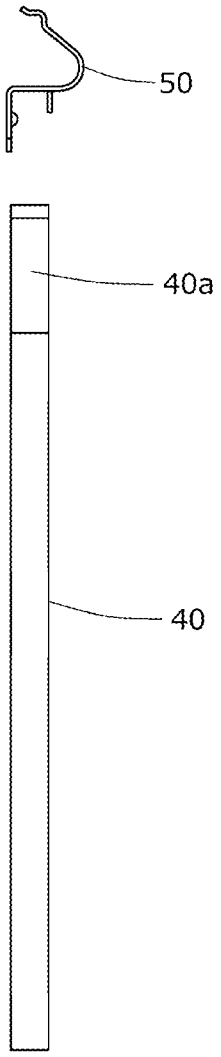
FIG. 9 is a side view of the audio-signal output circuit board and the biasing member, viewed along the arrow E of FIG. 8.

FIG. 9 is a side view of the circuit board 40 and the biasing member 50, viewed along the arrow E of FIG. 8.

The circuit board 40 has a shape of a substantially rectangular plate elongated in the front-rear direction. For example, an impedance converter for the electroacoustic transducer 20 and a circuit for converting a variation in capacitance of the capacitor into electrical signals and outputting the electrical signals are built in the circuit board 40.

The circuit board 40 has a narrow portion 40*a*, a cutout 40*b*, a cutout 40*c*, ground patterns 41, and signal patterns 42. The narrow portion 40*a* is disposed at the front end portions of the two opposite sides (hereinafter referred to as "long sides") of the circuit board 40 extending in the longitudinal direction (front-rear direction) of the circuit board 40. The width of the narrow portion 40*a* in the transverse direction is smaller than the width of the other portions of the circuit board 40 in the transverse direction. The width of the narrow portion 40*a* in the transverse direction is substantially equal to the inner diameter of the unit case 10. The length L1 of the narrow portion 40*a* in the front-rear direction is longer than the length L2 (see FIG. 7) from the rear end of the insulator 25 of the microphone unit 1 to the open end of the unit case 10 of the microphone unit 1.

The cutouts 40*b* and 40*c* are each disposed in the center portions of each of the two opposite sides (hereinafter referred to as "short sides") of the circuit board 40 extending in the transverse direction of the circuit board 40. The cutouts 40*b* and 40*c* are formed by cutting the short sides of the circuit board 40 toward the center of the circuit board 40.

The ground patterns 41 and the signal patterns 42 are composed of metal films. The ground patterns 41 are provided on both surfaces (the surfaces facing each other in the thickness direction of the circuit board 40) of the circuit board 40 adjacent to the outer peripheral edges (ridges) of the narrow portion 40*a* extending in the longitudinal direction, for example. The signal patterns 42 are provided on both surfaces (the surfaces facing each other in the thickness direction of the circuit board 40) of the front end portion of the circuit board 40 proximate to the cutout 40*b*, for example.

Another ground patterns may be provided on the side surfaces of the narrow portion 40*a* facing each other in the transverse direction. These ground patterns on the side surfaces may be connected to the ground patterns 41 provided on both surfaces (the surfaces facing each other in the thickness direction of the circuit board 40) of the circuit board 40.

The ground patterns may be provided on only one of the surfaces facing each other in the thickness direction of the circuit board.

The biasing member 50 electrically connects the electroacoustic transducer 20 to the circuit board 40. The biasing member 50 is a plate spring having a shape that is substantially a rectangle elongated in the front-rear direction. The biasing member 50 is composed of conductive metal, such as copper. The substantial front half of the biasing member 50 is bent in one direction into a shape that is substantially a V in side view, and the rear half of the biasing member 50 is bent in the opposite direction at substantially right angle in side view. That is, the biasing member 50 has a shape that is substantially an S in side view.

As shown in FIGS. 6 and 7, the microphone case 60 accommodates the microphone unit 1, the unit cover 30, the circuit board 40, and a part of the rear case 70. The microphone case 60 is composed of metal and has a shape of a hollow cylinder with a bottom end. The microphone case 60 has a front acoustic-wave entering hole 60*h*1, multiple rear acoustic-wave entering holes 60*h*2, and a screw hole 60*h*3. The front acoustic-wave entering hole 60*h*1 is disposed in the bottom of the microphone case 60, located at the front end of the microphone case 60. The front acoustic-wave entering hole 60*h*1 extends across the thickness (in the front-rear direction) of the bottom of the microphone case 60. The rear acoustic-wave entering holes 60*h*2 are disposed in the circumferential wall in the rear portion of the front half of the microphone case 60. The rear acoustic-wave entering holes 60*h*2 extend across the thickness of the circumferential wall of the microphone case 60. The screw hole 60*h*3 is disposed in the circumferential wall in the center of the rear half of the microphone case 60. The screw hole 60*h*3 extends across the thickness of the circumferential wall of the microphone case 60.

The rear case 70 is composed of metal and has a shape that is substantially a hollow cylinder. The front end surface of the rear case 70 is concave in cross-sectional view. The outer diameter of the front half of the rear case 70 is substantially equal to the inner diameter of the microphone case 60. The rear half of the rear case 70 has a shape that is substantially a hollow circular truncated cone tapered rearward. A microphone cable 90 is inserted into the rear case 70. The rear case 70 has a receiver 71. The receiver 71 is disposed on the outer circumferential surface of the rear case 70 and protrudes outward from the outer circumferential surface.

The mesh 80 is a metal mesh. The mesh 80 is attached to the inner circumferential surface of the microphone case 60. The mesh 80 covers the rear acoustic-wave entering holes 60*h*2 from the inside of the microphone case 60.

Method of Manufacturing a Condenser Microphone

The method of manufacturing a condenser microphone according to the present invention will now be described.

First, as described above, the microphone unit 1 is assembled by the process including accommodating the electroacoustic transducer 20 in the unit case 10, forming the protrusions 10*a* on the inner circumferential surface of the unit case 10, and fixing the electroacoustic transducer 20 with the protrusions 10*a*.

Then, the microphone unit 1 is inserted into the unit cover 30 through the opening of the unit cover 30. Thus, the outer circumferential surface of the unit case 10 comes into contact with the inner circumferential surface of the unit cover 30.

Then, the biasing member 50 is attached to the cutout 40*b* in the front end side of the circuit board 40. The front end portion of the biasing member 50 protrudes forward from the front end portion of the circuit board 40. The rear end portion of the biasing member 50 is fixed to the signal patterns 42 of the circuit board 40 by soldering, for example. Thus, the signal patterns 42 are electrically connected to the biasing member 50.

Then, the narrow portion 40*a* of the circuit board 40 to which the biasing member 50 is attached is fitted into the unit case 10. The front end surface of the circuit board 40 comes into contact with the rear end of the insulator 25. That is, the circuit board 40 is positioned by the contact with the insulator 25. As described above, the length L1 of the narrow portion 40*a* is longer than the length L2 (see FIG. 7) from the rear end of the insulator 25 to the open end of the unit case 10. Thus, the circuit board 40 is not in contact with the open end of the unit case 10. That is, the state of contact between the electroacoustic transducer 20 and the circuit board 40 does not vary depending on variations in manufacture of the open end of the unit case 10.

The biasing member 50 comes into contact with the bottom of the accommodating portion 26*a* of the support 26. That is, the biasing member 50 is disposed between the electroacoustic transducer 20 and the circuit board 40. The support 26 is electrically connected to the biasing member 50. Thus, the support 26 is electrically connected to the signal patterns 42. In other words, the electroacoustic transducer 20 is electrically connected to the circuit board 40. When the circuit board 40 is fitted into the unit case 10, the stress from the circuit board 40 is transferred to the electroacoustic transducer 20 via the biasing member 50. The stress is partly absorbed by compression of the biasing member 50, which is a plate spring. In other words, the biasing member 50 functions as a buffer between the electroacoustic transducer 20 and the circuit board 40.

The circuit board 40 is fixed to the rear case 70 with the rear end of the circuit board 40 inserted into the concave front end surface of the rear case 70. A part (not shown) of the ground patterns 41 of the circuit board 40 is electrically connected to the rear case 70. That is, the microphone case 60 and the rear case 70 are grounded with the ground patterns 41.

The circuit board 40 is electrically connected to a connector (not shown) with the microphone cable 90. The connector is, for example, an output connector including a pin 1 for ground, a pin 2 for hot signals, and a pin 3 for cold signals, and conforms to JEITA Standard RC-5236 "Circular Connectors, Latch-Lock Type for Acoustic Equipment."

Then, the microphone unit 1, the unit cover 30, the circuit board 40, the biasing member 50, and the part of the rear case 70 are inserted into the microphone case 60 through the opening of the microphone case 60 and are accommodated in the microphone case 60. The open end (rear end) of the microphone case 60 comes into contact with the receiver 71 of the rear case 70. In this state, the rear case 70 is fixed to the microphone case 60 with a screw (not shown), as in the state shown in FIG. 6. The front acoustic-wave entering hole 60*h*1 of the microphone case 60 communicates with the acoustic-wave entering hole 10*h* of the unit case 10 via the acoustic-wave entering hole 30*h* of the unit cover 30.

The outer circumferential surface of the unit cover 30 comes into contact with the inner circumferential surface of the microphone case 60. That is, the microphone unit 1 is electrically insulated from the microphone case 60 with the unit cover 30. As a result, the radio-frequency (RF) resistance of the microphone M increases.

Figure 10:
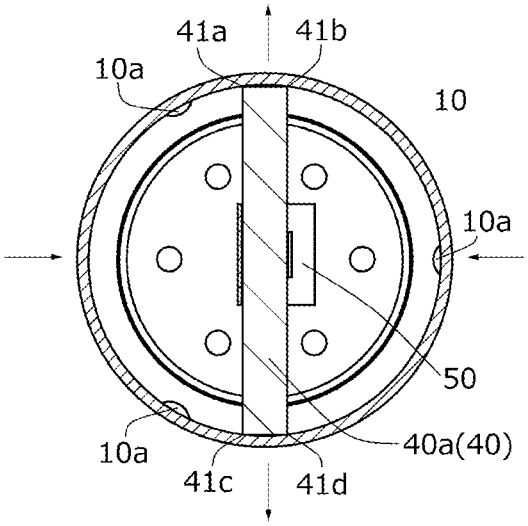
FIG. 10 is a cross-sectional view of the condenser microphone taken along the line D-D of FIG. 7.

FIG. 10 is a cross-sectional view of the microphone M taken along the line D-D of FIG. 7. In FIG. 10, the microphone case 60 is not illustrated. The arrows of FIG. 10 indicate the directions of deformation of the unit case 10 described below.

As described above, the width of the narrow portion 40*a* of the circuit board 40 is substantially equal to the inner diameter of the unit case 10. The circuit board 40 has a certain thickness. Thus, when the narrow portion 40*a* of the circuit board 40 is fitted into the unit case 10, the unit case 10 expands in the transverse direction (the vertical direction in FIG. 10) of the circuit board and contracts in the thickness direction (the transverse direction in FIG. 10) of the circuit board 40. As a result, when the centers of the components accommodated in the unit case 10 are deviated from each other (such deviation is hereinafter referred to as "relative eccentricity"), this relative eccentricity is corrected.

The narrow portion 40*a* of the circuit board 40 is in contact with the inner circumferential surface of the unit case 10 at the ground patterns 41*a*, 41*b*, 41*c*, and 41*d* provided on the four ridges of the narrow portion 40*a*. That is, the unit case 10 is electrically connected to the ground patterns 41 of the circuit board 40.

Figure 11:
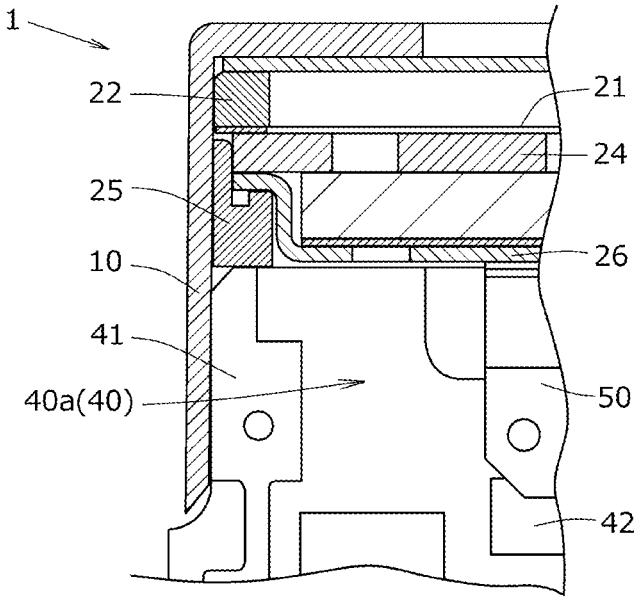
FIG. 11 is an enlarged view of the main configurations of the condenser microphone unit and the audio-signal output circuit board included in the condenser microphone in FIG. 6.

FIG. 11 is an enlarged view of the main configurations of the microphone unit 1 and the circuit board 40.

The ground patterns 41 of the circuit board 40 are in linear contact with the inner circumferential surface of the unit case 10. Accordingly, even when the circuit board 40 receives stress in the front-rear direction and the position of the circuit board 40 is displaced in the front-rear direction relative to the unit case 10, the electrical connection between the ground patterns 41 of the circuit board 40 and the unit case 10 is ensured.

The diaphragm 21 is electrically connected to the ground patterns 41 of the circuit board 40 with the diaphragm holder 22 and the unit case 10. On the other hand, the fixed electrode 24 is electrically connected to the signal patterns 42 of the circuit board 40 with the support 26 and the biasing member 50. The conduction path for grounding leading from the diaphragm 21 is insulated from the conduction path for electrical signals leading from the fixed electrode 24 with the insulator 25.

CONCLUSION

According to the embodiments described above, the electroacoustic transducer 20 accommodated in the unit case 10 is fixed inside the unit case 10 with the protrusions 10*a* formed on the inner circumferential surface of the unit case 10. Thus, the electroacoustic transducer 20 is certainly fixed inside the unit case 10 regardless of variations in manufacture of the open end of the unit case 10 and the circuit board 40. Accordingly, the electrical connection between the unit case 10 and the electroacoustic transducer 20 does not vary depending on variations in manufacture of the open end of the unit case 10 and the circuit board 40. That is, the conduction path for grounding of the diaphragm holder 22 and the unit case 10 is certainly ensured. In other words, the present invention can ensure the fixation of the electroacoustic transducer inside the unit case and the grounding of the electroacoustic transducer, regardless of variations in manufacture of the unit case and the circuit board.

The protrusions 10*a* are formed by pressing the outer circumferential surface of the unit case 10. Thus, the electroacoustic transducer 20 is fixed inside the unit case 10 with a simple structure.

In addition, the multiple protrusions 10*a* are disposed along the circumferential direction of the unit case 10. Thus, the electroacoustic transducer 20 is more certainly fixed inside the unit case 10.

Furthermore, the biasing member 50 is disposed between the electroacoustic transducer 20 and the circuit board 40. Thus, the electroacoustic transducer 20 is pressed on the unit case 10 by the biasing member 50. That is, the present invention can ensure the fixation of the electroacoustic transducer inside the unit case and the grounding of the electroacoustic transducer, regardless of variations in manufacture of the unit case and the circuit board.

The invention claimed is:

1. A condenser microphone unit comprising:

an electroacoustic transducer; and a unit case accommodating the electroacoustic transducer, wherein the unit case has a shape of tube and comprises a plurality of protrusions, the plurality of protrusions are disposed on an inner circumferential surface of the unit case along a circumferential direction of the unit case and are remote from each other, and the electroacoustic transducer is fixed inside the unit case with the plurality of protrusions.

2. The condenser microphone unit according to claim 1, wherein the electroacoustic transducer comprises:

a diaphragm;

a fixed electrode disposed behind the diaphragm, the fixed electrode constituting a capacitor with the diaphragm; and an insulator supporting the fixed electrode from a rear of the fixed electrode, and the plurality of protrusions are is in contact with the insulator.

3. The condenser microphone unit according to claim 1, wherein the plurality of protrusions are formed by pressing an outer circumferential surface of the unit case.

4. A method of manufacturing a condenser microphone comprising:

a condenser microphone unit; and a microphone case accommodating the condenser microphone unit, wherein the condenser microphone comprises:

an electroacoustic transducer; and a unit case accommodating the electroacoustic transducer, the method comprising:

accommodating the electroacoustic transducer in the unit case;

forming a protrusion on an inner circumferential surface of the unit case by pressing an outer circumferential surface of the unit case;

fixing the electroacoustic transducer in the unit case with the protrusion; and accommodating the unit case in the microphone case.

5. The method of manufacturing a condenser microphone according to claim 4, further comprising accommodating an audio-signal output circuit board and a biasing member in the microphone case, wherein the biasing member accommodated in the microphone case is disposed between the electroacoustic transducer and the audio-signal output circuit board.

6. The condenser microphone unit according to claim 1, wherein the plurality of protrusions are disposed on the inner circumferential surface of the unit case at regular intervals along the circumferential direction of the unit case.

7. The condenser microphone unit according to claim 1, wherein the unit case extends behind the plurality of protrusions.

8. The condenser microphone unit according to claim 1, wherein the unit case has a bottom end and an open end, the plurality of protrusions are disposed between the bottom end and the open end of the unit case.

9. A condenser microphone comprising:

a condenser microphone unit;

a microphone case accommodating the condenser microphone unit;

an audio-signal output circuit board connected to an electroacoustic transducer; and a biasing member disposed between the electroacoustic transducer and the audio-signal output circuit board, wherein the condenser microphone unit comprises:

the electroacoustic transducer; and a unit case accommodating the electroacoustic transducer, the unit case has a shape of a tube and comprises at least one protrusion, the at least one protrusion is disposed on an inner circumferential surface of the unit case, the electroacoustic transducer is fixed inside the unit case with the at least one protrusion, wherein the at least one protrusion comprises a plurality of protrusions, and the plurality of protrusions are disposed on the inner circumferential surface of the unit case along a circumferential direction of the unit case and are remote from each other.

* * * * *